US010906067B2

(12) United States Patent
Miette et al.

(10) Patent No.: US 10,906,067 B2
(45) Date of Patent: Feb. 2, 2021

(54) MODULAR AND SEPARABLE EQUIPMENT FOR AUTOMATICALLY SORTING PARCELS INTO BAGS

(71) Applicant: Solystic, Bagneux (FR)

(72) Inventors: Emmanuel Miette, Saint-Gratien (FR); Thierry Garnier, Beauvallon (FR); Luc Chirol, Paris (FR)

(73) Assignee: SOLYSTIC

( * ) Notice: Subject to any disclaimer, the term of this patent is extended or adjusted under 35 U.S.C. 154(b) by 90 days.

(21) Appl. No.: 15/303,187

(22) PCT Filed: Jun. 30, 2016

(86) PCT No.: PCT/FR2016/051661
§ 371 (c)(1),
(2) Date: Jul. 17, 2018

(87) PCT Pub. No.: WO2017/051089
PCT Pub. Date: Mar. 30, 2017

(65) Prior Publication Data

US 2018/0333750 A1 Nov. 22, 2018

(30) Foreign Application Priority Data

Sep. 25, 2015 (FR) ..... 15 59061

(51) Int. Cl.
*B07C 3/08* (2006.01)
*B07C 5/36* (2006.01)
*B07C 3/02* (2006.01)

(52) U.S. Cl.
CPC ..... *B07C 3/08* (2013.01); *B07C 3/02* (2013.01); *B07C 5/36* (2013.01)

(58) Field of Classification Search
CPC .... B07C 3/02; B07C 3/08; B07C 3/36; B65G 47/38; B65G 47/962; B65G 17/002;
(Continued)

(56) References Cited

U.S. PATENT DOCUMENTS 6,762,382 B1 * 7/2004 Danelski ..... B07C 5/36 198/370.04
7,547,174 B1 * 6/2009 Pippin ..... B07C 3/02 198/626.1

(Continued)

FOREIGN PATENT DOCUMENTS

WO 2014057182 A1 4/2014

OTHER PUBLICATIONS

French Search Report and Written Opinion dated May 19, 2016 for Application No. FR1559061.

*Primary Examiner* — Charles A Fox
*Assistant Examiner* — Kalyanavenkateshware Kumar
(74) *Attorney, Agent, or Firm* — Ware, Fressola, Maguire & Barber LLP

(57) ABSTRACT

Equipment for sorting parcels into bags comprises a bag support having a modular structure with modules that are provided with braked wheels and that are arranged to be coupled together in separable manner, at least one mobile shuttle robot cart and trolley assembly that is caused to be moved by being remotely controlled by a monitoring and control unit to move parcels to be sorted along the bags, and floor marking that is arranged along the bag support modules and that is detectable by the shuttle cart and trolley assembly while said shuttle cart and trolley assembly is moving along the bag support modules.

5 Claims, 1 Drawing Sheet

(58) Field of Classification Search
CPC ..... B65G 17/12; B65G 1/10; B65G 1/137; B65G 1/1378; G06Q 10/087
See application file for complete search history.

(56) References Cited

U.S. PATENT DOCUMENTS

| | | | | |
|---|---|---|---|---|
| 8,807,320 | B2 * | 8/2014 | Fortenbery | B65G 47/962 198/370.03 |
| 2006/0210382 | A1 * | 9/2006 | Mountz | B65G 1/137 414/498 |
| 2015/0235165 | A1 * | 8/2015 | Miette | G06Q 10/083 705/337 |
| 2016/0176637 | A1 * | 6/2016 | Ackerman | B65G 1/1375 700/215 |

* cited by examiner

MODULAR AND SEPARABLE EQUIPMENT FOR AUTOMATICALLY SORTING PARCELS INTO BAGS

TECHNICAL FIELD

The invention relates to the field of postal sorting, and it relates more particularly to equipment for sorting parcels into bags.

PRIOR ART

Currently, sorting parcels at low throughput rates is not automated very much in sorting centers.

Such "low" throughput rates are rates that can be up to three thousand parcels per hour.

This type of sorting is generally performed manually by specialist operators who take the parcels one-by-one from a take point, who visually recognize a destination on a parcel that has been taken, and then, as a function of a certain sorting plan, determine the sorting bag into which the parcel should be dropped off.

The sorting bags can then be recovered for delivery on a delivery round or "postman's walk" or they can be emptied for sorting the parcels in a new sorting pass.

Thus, the sorting rate at which parcels are sorted in such sorting centers depends essentially on the number of operators at work there and on their skill at sorting the parcels into the bags as a function of the sorting plan.

It can also be understood that the sorting plans changing at every sorting pass requires a substantial effort of concentration on the part of the operators, and that can give rise to sorting errors.

In addition, that type of equipment occupies a large floor area in a sorting center, and that floor area cannot be used for other tasks.

SUMMARY OF THE INVENTION

An object of the invention is therefore to remedy those various drawbacks.

To this end, the invention provides equipment for sorting parcels into bags, said equipment being characterized in that it comprises a receptacle support having a modular structure with modules each provided with braked wheels and that are arranged to be coupled together in separable manner by interfitting engagement, in that it further comprises at least one mobile shuttle robot cart and trolley assembly that is caused to be moved by being remotely controlled by a monitoring and control unit arranged to bring the shuttle robot cart and trolley assembly to a loading point where a parcel to be sorted is placed on the shuttle robot cart and trolley assembly and then to move said shuttle robot cart and trolley assembly with the parcel towards one of the receptacles that is determined by said unit as a function of a sorting indication read automatically on the parcel, and in that floor marking is provided that is arranged along the receptacle support modules and that is detectable by the shuttle robot cart while said shuttle robot cart is moving along said receptacle support modules.

The basic idea of the invention is thus to propose automatic sorting equipment for sorting parcels into receptacles, in particular into bags, the equipment being modular and separable and in which mobile shuttle robot carts moving on the floor along permanent marking automatically sort the parcels under the control of a monitoring and control unit in which a sorting plan is recorded. The modular and separable bag support is readily movable due to the fact that the modules are wheeled and the entire equipment can be stowed away rapidly at the end of a bag sorting operation, thereby making it possible to use the space freed up in the sorting center for some other task.

In particular, the mobile support modules can be moved rapidly on installation or on removal by operators or by shuttle robot carts under the control of the monitoring and control unit.

This arrangement of the invention thus makes it possible to reduce the costs of operating this type of installation by optimizing the use of the space in a postal sorting logistics center.

The equipment of the invention may advantageously have the following features:

- said receptacle support modules are disposed in two parallel rows and are interconnected mechanically by upside-down U-shaped link tubes suitable for coming into engagement by interfitting;
- said floor marking may be arranged between the two parallel rows of receptacle support modules; and
- each bag support module and each shuttle cart and trolley assembly has, as seen from the side, the shape of a carrier frame with an upright and a head, the carrier frame of the trolley and the carrier frame of the support being arranged to fit or nest mutually one in the other.

In particular, the receptacles are bags but they may be replaced by trays or bins or by other receptacles that can be fastened to the support modules and that can receive the parcels sorted by the shuttle robot carts.

BRIEF DESCRIPTION OF THE DRAWING

The present invention can be better understood and other advantages appear on reading the following detailed description of an embodiment given by way of non-limiting example and with reference to the accompanying drawing, in which.

DESCRIPTION OF EMBODIMENTS

The sorting equipment of the invention is designed to sort articles, and more particularly non-machine-sortable postal articles of the parcel type, at a low throughput rate.

Figure 1:
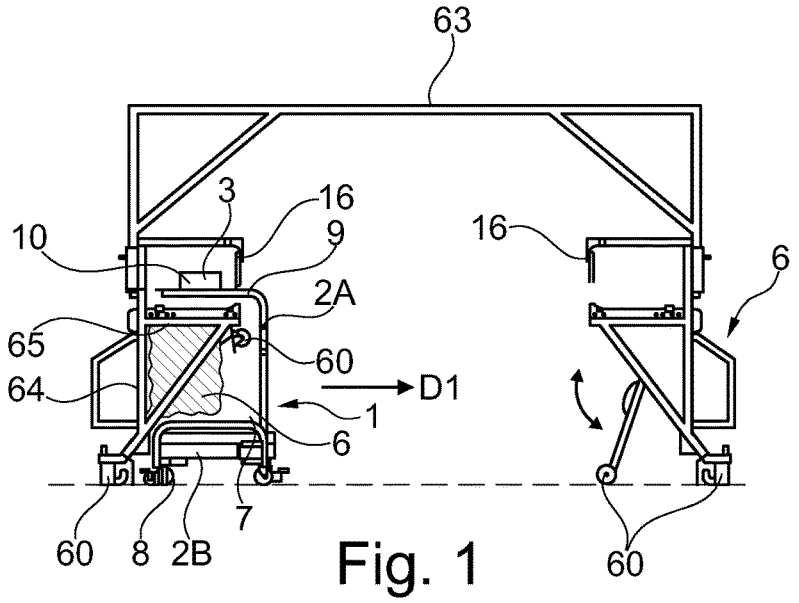
FIG. 1 is a side view showing the bag support modules and a shuttle cart and trolley assembly.
Figure 2:
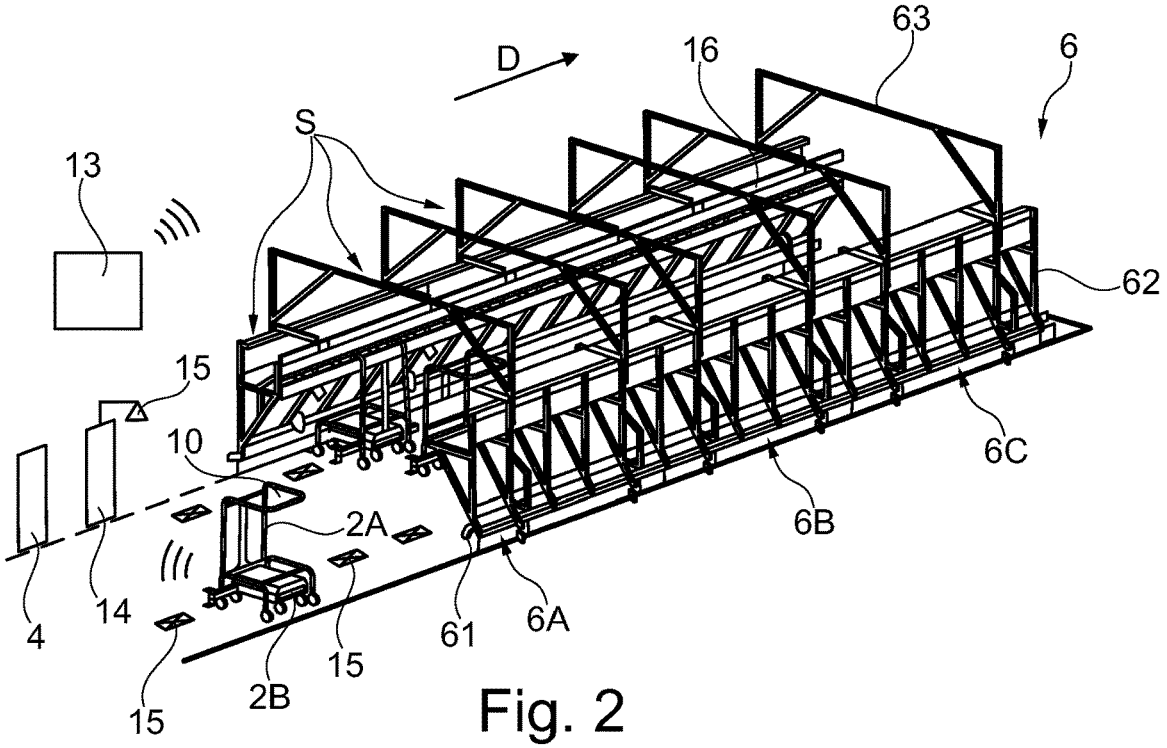
FIG. 2 is an overall perspective view of equipment of the invention including two rows of bag support modules.

With reference to FIGS. 1 and 2, the sorting equipment of the invention comprises one or more shuttle cart and trolley assemblies 1, each of which is made up of a trolley 2A for carrying a parcel 3 and of a shuttle robot cart 2B for moving the parcel 3 placed on the trolley 2A.

The trolley 2A and the shuttle cart 2B may optionally be designed to be coupled to each other in detachable manner. In this example the trolley is mounted on wheels.

Each shuttle robot cart 2B is an independent self-propelled robot cart that, for automatically sorting parcels, is cable of moving over the floor between a loading point 4 for loading the parcels 3, which point is shown in FIG. 2, and parcel drop-off points S constituting sorting outlets where, in this example, bags are disposed that are open at their tops.

As can be seen in FIG. 1, each trolley 2A is, in profile, in the shape of a carrier frame, and, in this example, in the shape of a U on its side, forming a carrier frame upright 7 above the wheels 8 of the motor-driven shuttle cart 2B and a carrier frame head 9 to which a horizontal carrying deck 10 is fastened for carrying a parcel 3.

In addition, the equipment of the invention further comprises a bag support 6 that has a modular structure with tubular modules 6A, 6B, 6C, each of which is mounted on braked wheels 60 so as to be readily movable on the floor, e.g. between a storage zone and a sorting zone.

In accordance with the invention, these bag support modules such as 6A, 6B, and 6C are arranged to be coupled readily together in line in the direction D in separable manner by interfitting engagement.

Figure 3:
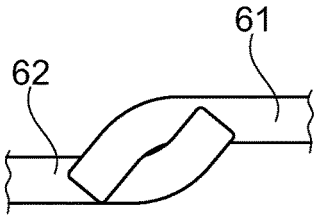
FIG. 3 shows a module coupling system that is readily separable.

FIG. 3 shows a coupling system for coupling together two adjacent modules by interfitting engagement, which system is, in this example, constituted by curved-over catches 61, 62 that come to be interlaced and that are provided on the sides of respective ones of the two adjacent modules.

FIGS. 1 and 2 also show a coupling system for coupling the bag support modules together in two parallel rows, which system is, in this example, constituted by U-shaped link tubes 63 suitable for coming into interfitting engagement.

As shown in FIG. 1, each module has, in profile, the shape of a carrier frame with a carrier frame upright 64 and a carrier frame head 65 that carries an open-top bag 6 by suspending said bag 6.

The shuttle cart and trolley assemblies 1 and the modular bag support 1 are designed in such a manner that the carrier frame head 9 of a shuttle cart and trolley assembly fits or nests above the carrier frame head 65 of a bag support module, thereby enabling a parcel 3 placed on the deck 10 of a shuttle cart and trolley assembly to be brought vertically above the opening of a bag 6, as shown in FIG. 1, and to be caused to fall by gravity into said bag as explained below.

More particularly, as shown in FIG. 1, in each bag support module, retaining means 16 are provided above the carrier frame head 65, which retaining means leave a space enabling the carrier frame head 9 of a shuttle cart and trolley assembly to pass under them, and retain the object 3 loaded on the deck 10 above the opening of the bag 3 when the shuttle cart and trolley assembly 1 moves away from the bag 6 in the direction D1, thereby causing the parcel 3 to fall by gravity into the bag 6.

Said retaining means 16 may be in the form of a paddle formed by a dropped edge. FIG. 2 shows a long paddle 16 that extends over the entire length of a plurality of adjacent bag support modules.

FIG. 2 very diagrammatically shows a monitoring and control system 13 for monitoring and controlling the shuttle cart and trolley assemblies 1 with an automatic address recognition system 14 including a camera 15 that is mounted at some height so that it can observe the top face of each parcel 3 placed on the carrying deck 10 of a shuttle cart and trolley assembly 1 passing under the camera. The camera 14 forms a digital image of the parcel that bears the address information, which information can be recognized automatically by the system 13 as is known by the person skilled in the art.

It is understood that the shuttle cart and trolley assemblies 1 are remote controlled in wireless manner from the system 13 so as to move past the sorting outlets S and so as to drop parcels off into the bags 6 suspended in the bag support modules.

FIG. 2 does not show said bags 6 but it should be understood that, for the example shown in FIG. 2, there are five bags per module and therefore the parcel sorting equipment shown in FIG. 2 has a large number of bags aligned in two parallel rows, which bags constitute as many sorting outlets.

In FIG. 2, floor marking 15 is shown that extends over the entire path for the shuttle cart and trolley assemblies in a logistics sorting center, and, in this example, said floor marking extends between the two rows of bag support modules facing each bag 6. In this configuration of the equipment, the shuttle cart and trolley assemblies travel between the two rows of bags, and the equipment is therefore relatively compact in terms of the floor area it occupies, even when it has many sorting outlets.

This floor marking 15, which, in this example, is in the form of a succession of bar codes such as Quick Response (QR) codes uniformly spaced apart over the path of the shuttle robot carts, is designed to be automatically detectable by the shuttle robot carts while they are moving around.

The floor marking is permanent and serves as geolocation means for the shuttle robot carts, e.g. for enabling a shuttle cart to be positioned, for example, facing a bag corresponding to a sorting outlet for a parcel.

For sorting the parcels 3 into bags, each shuttle cart and trolley assembly carrying a parcel comes to the beginning of a row of bag support modules and travels along said row of modules by using the floor marking 15.

The parcel 3 is then moved above successive bags and, as a function of the delivery address for the parcel that is detected by the system 13, the shuttle cart and trolley assembly is stopped above the bag 6 that corresponds to the sorting outlet for said delivery address and moved out from the row, thereby causing the parcel 3 as retained by the paddle 16 to fall merely by gravity into the bag 6.

With this arrangement of the invention, it is possible in a parcel sorting center to make provision, for example, for a morning sort over forty directions (forty bags) that is organized on a single row of bag support modules, and for a parcel sort in the afternoon that is organized on two parallel rows of bag support modules with, in addition, the installation being totally removed by separating the modules after the morning sort and after the afternoon sort so as to free up space in the sorting center.

In addition, the morning sort may be performed with a small fraction of the bag support modules in a certain zone of the sorting center while the afternoon sort may be performed with all of the bag support modules available but in another zone of the sorting center.

Between the morning sort and the afternoon sort, the bag support modules can be removed rapidly by an operator and readily transported by wheeling them into a stowage zone provided for that purpose in the sorting center and where they can be stowed in compact manner with the shuttle cart and trolley assembly(ies).

As can be seen in FIG. 1, the front braked wheels 60 (in the middle in FIG. 1) of the bag support modules are designed to be retractable so as to free up space under the carrier frame head 65 and so as to allow the shuttle cart and trolley assemblies to travel along the sorting outlets as explained above. This arrangement contributes to the compactness of the bag support.

In addition, at the rear braked wheels 60 (on the left or on the right in FIG. 1), a floor pointer device (a retractable spike) is provided that is designed to be put into coincidence with a positioning mark provided on the floor, thereby enabling the operator to position the bag support modules rapidly and appropriately relative to the path along which the shuttle cart and trolley assemblies travel.

With this modular and separable arrangement of the invention, a lone operator is capable of performing automatic sorting into bags over a large number of destinations while also removing and re-installing the sorting installation after each sorting stage.

During the sorting, the operator is positioned at the loading point 4 so as to load parcels manually onto the shuttle cart and trolley assemblies, the sorting into bags then being performed automatically by the shuttle cart and trolley assemblies under the control of the system 13. If the sorting has a plurality of sorting passes, the bags 6 can be removed from the bag support by the operator and replaced with empty bags.

The invention claimed is:

1. An equipment for sorting parcels into bags, said equipment being characterized in that it comprises a receptacle support to support said bags, the receptacle support having a modular structure with modules each provided with braked wheels, each module comprising a coupling system for coupling together two adjacent ones of the modules in a separable manner by interfitting engagement, in that it further comprises at least one mobile shuttle robot cart and trolley assembly that is caused to be moved by being remotely controlled by a monitoring and control unit arranged to bring the shuttle robot cart and trolley assembly to a loading point where a parcel to be sorted is placed on the shuttle robot cart and trolley assembly and then to move said shuttle robot cart and trolley assembly with the parcel towards one of the receptacles that is determined by said monitoring and control unit as a function of a sorting indication read automatically on the parcel, and a floor marking is provided that is arranged along the receptacle support modules and that is detectable by the shuttle robot cart while said shuttle robot cart is moving along said receptacle support modules, wherein said receptacle support modules are disposed in two parallel rows and are interconnected mechanically by upside-down U-shaped link tubes suitable for coming into engagement by interfitting.

2. The equipment according to claim 1, characterized in that said floor marking is arranged between the two parallel rows of receptacle support modules.

3. The equipment according to claim 1, characterized in that the receptacles are bags.

4. The equipment according to claim 3, characterized in that each bag support module and each shuttle cart and trolley assembly has, as seen from the side, the shape of a carrier frame with an upright and a head, the carrier frame of the trolley and the carrier frame of the support being arranged to fit or nest mutually one in the other.

5. An equipment for sorting parcels into bags, said equipment being characterized in that it comprises a receptacle support to support said bags, the receptacle support having a modular structure with modules each provided with braked wheels, each module comprising a coupling system for coupling together two adjacent ones of the modules in a separable manner by interfitting engagement, in that it further comprises at least one mobile shuttle robot cart and trolley assembly that is caused to be moved by being remotely controlled by a monitoring and control unit arranged to bring the shuttle robot cart and trolley assembly to a loading point where a parcel to be sorted is placed on the shuttle robot cart and trolley assembly and then to move said shuttle robot cart and trolley assembly with the parcel towards one of the receptacles that is determined by said monitoring and control unit as a function of a sorting indication read automatically on the parcel, and a floor marking is provided that is arranged along the receptacle support modules and that is detectable by the shuttle robot cart while said shuttle robot cart is moving along said receptacle support modules, wherein the receptacles are bags, and wherein one of the modules comprises retaining means configured to make a parcel disposed on a trolley assembly to fall by gravity into a corresponding one of the bags when the trolley assembly moves away from this bag.

* * * * *